US006454331B1

(12) United States Patent
Ahlenius

(10) Patent No.: US 6,454,331 B1
(45) Date of Patent: Sep. 24, 2002

(54) GOLF BALL RETRIEVER

(76) Inventor: Roger Ahlenius, 39 Vendola Dr., San Rafael, CA (US) 94903

( * ) Notice: Subject to any disclaimer, the term of this patent is extended or adjusted under 35 U.S.C. 154(b) by 0 days.

(21) Appl. No.: 09/749,150

(22) Filed: Dec. 27, 2000

Related U.S. Application Data

(60) Provisional application No. 60/197,000, filed on Apr. 13, 2000.

(51) Int. Cl.[7] ..... A63B 47/02
(52) U.S. Cl. ..... 294/19.2
(58) Field of Search ..... 294/19.1, 19.2, 294/55.5, 66.1, 26; 37/316; 56/328.1, 332, 400.01, 400.04, 400.11; 473/286

(56) References Cited

U.S. PATENT DOCUMENTS

| | | | | | |
|---|---|---|---|---|---|
| 2,109,377 | A | * | 2/1938 | Airington | 294/19.1 |
| 2,738,214 | A | | 3/1956 | Zimmers | |
| 3,014,749 | A | * | 12/1961 | Carrow | 294/26 |
| D206,076 | S | * | 10/1966 | Lehman | 294/19.2 X |
| 3,434,753 | A | * | 3/1969 | De Croes | 294/192 |
| 3,773,374 | A | | 11/1973 | D'Luhy | |
| 4,046,413 | A | | 9/1977 | Jeninga | |
| 4,077,659 | A | * | 3/1978 | Sievers | 294/19.2 |
| 4,254,981 | A | | 3/1981 | Wilson | |
| 5,326,145 | A | | 7/1994 | Lee | |
| 5,482,338 | A | * | 1/1996 | Hall | 294/19.2 |
| 5,758,915 | A | | 6/1998 | Quinn et al. | |
| 5,997,062 | A | | 12/1999 | Schwartz | |

* cited by examiner

*Primary Examiner*—Johnny D. Cherry

(57) ABSTRACT

The present golf ball retriever is comprised of a telescopic arm, and a claw rigidly attached to the distal end of the arm. The claw is comprised of a pair of laterally spaced fingers joined at their proximal ends by a curved horizontal connecting bar. The fingers are respectively comprised of guide rails forward of the connecting bars, backwardly curved hooks forward of and downward from the guide rails, and backwardly directed straight extensions at the distal ends of the curved hooks. The fingers are generally parallel to each other when seen in a top or bottom view. The extensions are parallel to the rails when seen in a side view. The outer span between the fingers is no greater than the diameter of a golf ball. The rails are adapted to guide the ball toward the curved hooks. The extensions prevent the ball from falling off the hooks.

8 Claims, 1 Drawing Sheet

GOLF BALL RETRIEVER

CROSS REFERENCE TO RELATED APPLICATIONS

This patent claims the benefit of a provisional patent application with application Ser. No. 60/197,000, filed on Apr. 13, 2000.

BACKGROUND OF THE INVENTION

1. Field of the Invention

This invention relates generally to devices for retrieving golf balls.

2. Prior Art

Golf balls frequently fall into bushes and ponds where they are beyond an arm's reach. Accordingly, various golf ball retrievers have been devised for recovering balls from inaccessible places. For example, a retriever disclosed in U.S. Pat. No. 2,738,214 to Zimmers is comprised of a claw on the end of a long arm. There are curled fingers on the claw for hooking a ball. The fingers are short and converge together. Because the claw is very narrow, placing it precisely over the ball would be very difficult by manipulating the long arm. A retriever disclosed in U.S. Pat. No. 3,773,374 to D'Luhy is comprised of a pair of hooks hinged to the end of an arm. The hooks are loosely hinged, so that if they are pushed along the bottom of a pond or into stiff bushes, they would be rotated to a rearward pointing direction and would not be able to pick up the ball.

A retriever disclosed in U.S. Pat. No. 4,046,413 to Jeninga is comprised of two loops positioned one on top of another at the end of a long arm. The loops are lowered around a ball, and a pivoted gate between the loops is operated to trap the ball between the loops. However, the gate cannot operate on tall grass, which would tend to push the gate up when the retriever is lowered onto the grass, and keep the gate from operating.

A retriever disclosed in U.S. Pat. No. 4,254,981 to Wilson is comprised of a rake with several hooked fingers radiating out from the end of a long arm. The rake is so wide that it cannot go into bushes or through fences. A retriever disclosed in U.S. Pat. 5,326,145 to Lee is comprised of a pair of flexible loops on the end of a long arm. The loops are pushed against the ball to force the ball between them. However, the force required to open the loops tends to push the ball away before the loops open up to admit the ball.

A retriever disclosed in U.S. Pat. No. 5,758,915 to Quinn et al. is comprised of a rake with hooked fingers. The distal ends of the fingers are angled downward, so that the ball would tend to fall out. Another retriever disclosed in U.S. Pat. No. 5,997,062 to Schwartz is comprised of a pair of hooked fingers on the end of a long arm. Intermediate segments of the fingers flare outwardly to guide the ball into the hooked ends, but their angular shapes also tend to trap the ball between them and prevent the ball from reaching the hooked ends.

OBJECTIVES OF THE INVENTION

Accordingly, the objectives of the present golf ball retriever are:

- to retrieve golf balls from places which are beyond a hand's reach;
- to be narrow enough to reach into thick bushes and through fences;
- to be rigid for reliably pushing through bushes, tall grass, fallen leaves, mud, etc.;

- to have no movable parts for reliability;
- to guide the ball inside for reliable capture; and
- to be easy to clean.

Further objectives of the present invention will become apparent from a consideration of the drawings and ensuing description.

BRIEF SUMMARY OF THE INVENTION

The present golf ball retriever is comprised of a telescopic arm, and a claw rigidly attached to the distal end of the arm. The claw is comprised of a pair of laterally spaced fingers joined at their proximal ends by a curved horizontal connecting bar. The fingers are respectively comprised of guide rails forward of the connecting bars, backwardly curved hooks forward of and downward from the guide rails, and backwardly directed straight extensions at the distal ends of the curved hooks. The fingers are generally parallel to each other when seen in a top or bottom view. The extensions are parallel to the rails when seen in a side view. The outer span between the fingers is no greater than the diameter of a golf ball. The rails are adapted to guide the ball toward the curved hooks. The extensions prevent the ball from falling off the hooks.

BRIEF DESCRIPTION OF THE SEVERAL VIEWS OF THE DRAWING

FIG. 5 is a top perspective view of the claw when the ball is supported between the curved sections.

DRAWING REFERENCE NUMERALS

| | |
|---|---|
| 10. | Arm |
| 11. | Claw |
| 12. | Fingers |
| 13. | Connecting Bar |
| 14. | Guide Rails |
| 15. | Curved Hooks |
| 16. | Extensions |
| 17. | Golf Ball |

DETAILED DESCRIPTION OF THE INVENTION

FIG. 1

Figure 1:
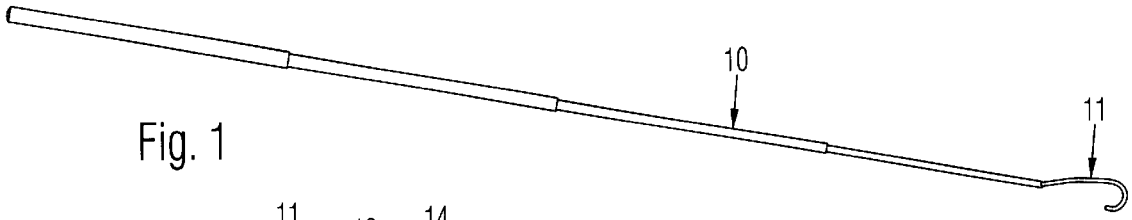
FIG. 1 is a side view of the present golf ball retriever.

A preferred embodiment of the present golf ball retriever is shown in a side view in FIG. 1. It is comprised of a long arm 10, and a claw 11 rigidly attached to a forward end of arm 10. Since claw 11 is rigidly attached to arm 10, claw 11 can be pushed through bushes, weeds, and mud without being moved out of position. Arm 10 is preferably long enough for reaching up to branches on trees, deep into bushes and ponds, through fences, and many other places out of a hand's reach. Arm 10 is also preferably a telescopic arm.

FIGS. 2–3

Figure 2:
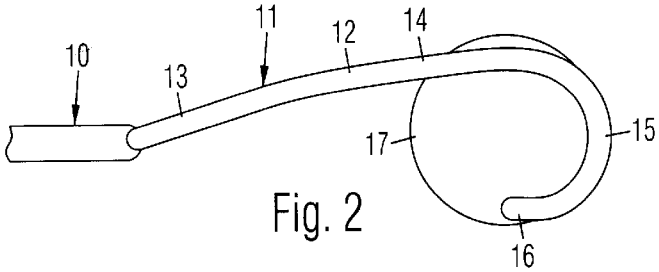
FIG. 2 is a side view of a claw thereof.
Figure 3:
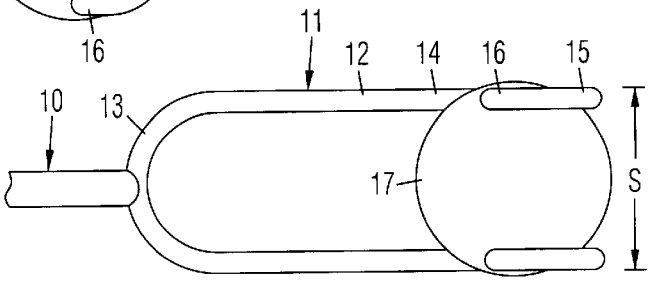
FIG. 3 is a bottom view of the claw.

Claw 11 is shown in a side view in FIG. 2 and a bottom view in FIG. 3. It is comprised of a pair of laterally spaced fingers 12 joined at their proximal ends by a curved horizontal connecting bar 13. Fingers 12 are respectively comprised of guide rails 14 forward of connecting bars 13, backwardly curved hooks 15 forward of and downward from guide rails 14, and backwardly directed straight extensions 16 at the lower ends of curved hooks 15. Fingers 12 are generally parallel to each other when seen in a top view or a bottom view. Extensions 16 are parallel to the forward ends of rails 14 when seen in a side view. The outer span S between fingers 12 is no greater than the diameter of a golf ball 17. The rear end of claw 11 is preferably slightly curved downwardly when seen in a side view for helping direct golf ball 17 forwards.

FIGS. 4–6

Figure 4:
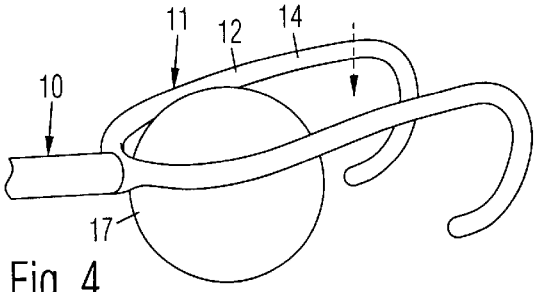
FIG. 4 is a top perspective view of the claw when initially placed on a golf ball.
Figure 5:
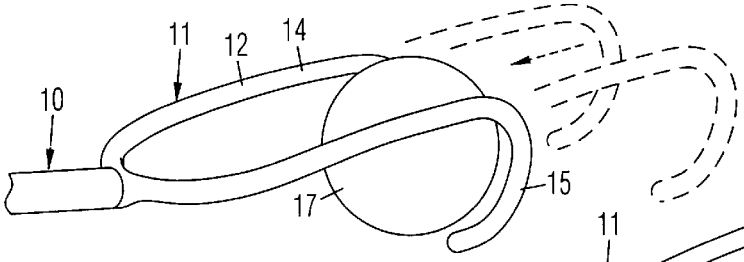
FIG. 5 is a top perspective view of the claw when guiding the ball into its curved sections.
Figure 6:
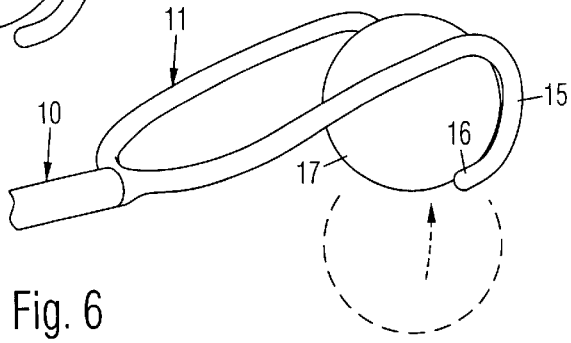

The operation of the present golf ball retriever is shown in FIGS. 4–6. Since claw 11 is comprised of only two fingers, it is narrow enough to reach into thick bushes, branches, weeds, and other tight spaces. In FIG. 4, claw 11 is lowered onto golf ball 17. When used in a pond, the thin fingers 12 tend not to stir up mud that might otherwise obscure the ball. Guide rails 14 are preferably at least as long as the diameter of golf ball 17, which is long enough for being easily placed on the ball without the need for precise positioning. Since precisely controlling claw 11 at the end of long arm 10 is difficult, guide rails 14 make capturing golfball 17 easier. As soon as guide rails 14 are placed on golf ball 17, claw 11 is stabilized on golf ball 17 by guide rails 14 and prevented from slipping off. In FIG. 5, claw 11 is pulled to roll golf ball 17 toward curved hooks 15. Golf ball 17 is directed by parallel guide rails 14 toward curved hooks 15 to ensure capture. In FIG. 6, claw 11 is lifted to remove golf ball 17 from its resting place. Extensions 16 prevent golfball 17 from falling off curved hooks 15. Claw 11 is reliable because it has no moving parts, and its simple structure makes it easy to clean.

SUMMARY AND SCOPE

Accordingly, the present golf ball retriever is long enough to retrieve golf balls from places which are beyond a hand's reach. It is narrow enough to reach into thick bushes, branches, and other tight spaces. Its rigid claw can reliably go through bushes, tall grass, fallen leaves, mud, etc. The guide rails make the claw easy to place on the ball. The guide rails reliably direct the ball toward the curved hooks for capture. It is reliable because it has no moving parts, and it is easy to clean.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A golf ball retriever consisting of:

an arm; and a claw rigidly attached to a forward end of said arm for pushing through vegetation and mud without being moved out of position relative to said arm, wherein said claw is comprised of only two laterally spaced rigid fingers joined at respective proximal ends thereof by a curved horizontal connecting bar, an outer span between said fingers is generally no greater than a diameter of a golf ball for capturing and supporting said golf ball anywhere along said fingers, and for being narrow enough to pass through said vegetation, said fingers are respectively comprised of:

guide rails forward of said connecting bar, wherein said guide rails rest stably on said golf ball without slipping off and to guide said golf ball, said guide rails are generally parallel to each other when seen in top view for guiding said golf ball; and backwardly curved half-circle hooks forward of and depending from said guide rails, wherein said curved half-circle hooks hold said golf ball which is guided in by said guide rails.

2. The golf ball retriever of claim 1, wherein said arm is comprised of a telescopic arm.

3. The golf ball retriever of claim 1, wherein a rear end of said claw is curved downwardly for helping direct said golf ball forwardly towards said curved hooks.

4. A golf ball retriever consisting of:

An arm; and a claw rigidly attached to a forward end of said arm for pushing through vegetation and mud without being moved out of position relative to said arm, wherein said claw is comprised of only two laterally spaced fingers joined at respective proximal ends thereof by a curved horizontal connecting bar, an outer span between said fingers is generally no greater than a diameter of a golf ball for capturing and supporting said golf ball anywhere along said fingers, and for being narrow enough to pass through said vegetation, said fingers are respectively comprised of:

guide rails forward of said connecting bar, wherein said guide rails rest stably on said golf ball without slipping off and to guide said golf ball, said guide rails are generally parallel to each other when seen in top view for guiding said golf ball; and backwardly half-circle curved hooks forward of and depending from said guide rails, wherein said curved hooks form a pouch to hold said golf ball which is guided in by said guide rails, and said pouch, at the distal end of said fingers, comprised of said rails and said hooks and said tips, is only minimally larger than said golf ball;

backwardly directed straight extensions at lower ends of said curved hooks, wherein said extensions support said golf ball in said pouch, and said extensions and are generally parallel to forward ends of said guide rails when seen in a side view for holding said golf ball in said pouch.

5. The golf ball retriever of claim 4, wherein said arm is comprised of a telescopic arm.

6. The golf ball retriever of claim 4, wherein a rear end of said claw is curved downwardly for helping direct said golf ball forwardly into said pouch.

7. A golf ball retriever consisting of:

an arm; and a claw rigidly attached to a forward end of said arm for pushing through vegetation and mud without being moved out of position relative to said arm, wherein said claw is comprised of only two laterally spaced fingers joined at respective proximal ends thereof by a curved horizontal connecting bar, an outer span between said fingers is generally no greater than a diameter of a golf ball for supporting said golf ball anywhere along said fingers, and for being narrow enough to pass through said vegetation, said fingers are respectively comprised of:

guide rails forward of said connecting bar, wherein said guide rails are at least about as long as said diameter of said golf ball for being placed on said golf ball without the need for precise positioning, said guide rails rest stably on said golf ball without slipping off and to guide said golf ball, said guide rails are generally parallel to each other when seen in top view for guiding said golf ball;

backwardly half-circle curved hooks forward of and depending from said guide rails, wherein said curved hooks form a pouch to hold said golf ball which is guided in by said guide rails, and backwardly directed straight extensions at lower ends of said curved hooks, wherein said extensions support said golf ball in said pouch, and said extensions are generally parallel to forward ends of said guide rails when seen in a side view for holding said golf ball in said curved hooks;

wherein a rear end of said claw is curved downwardly for helping direct said golf ball forwardly towards said curved hooks, said pouch, at the distal end of said fingers, comprised of said rails and said hooks and said tips, is minimally larger than said golf ball.

8. The golf ball retriever of claim 7, wherein said arm is comprised of a telescopic arm.

* * * * *